US005595548A

United States Patent [19]

Beck

[11] Patent Number: 5,595,548

[45] Date of Patent: Jan. 21, 1997

[54] METHOD OF MANUFACTURING GOLF CLUB HEAD WITH INTEGRAL INSERT

[75] Inventor: William C. Beck, Rancho Palos Verdes, Calif.

[73] Assignee: Northrop Grumman Corporation, Los Angeles, Calif.

[21] Appl. No.: 388,762

[22] Filed: Feb. 15, 1995

[51] Int. Cl.[6] ..... A63B 53/04

[52] U.S. Cl. ..... 473/324; 473/349; 473/350

[58] Field of Search ..... 273/167 R, 167 A, 273/167 H, 169, 171, 170, 172, 173, 174, 175, 167 F, 77 R, 193 R, 194 R; 473/324–350

[56] References Cited

U.S. PATENT DOCUMENTS

| | | | |
|---|---|---|---|
| 2,846,228 | 8/1958 | Reach | 273/169 |
| 3,975,023 | 8/1976 | Inamori | 273/173 |
| 3,995,865 | 12/1976 | Cochran | 273/167 F |
| 4,326,326 | 4/1982 | MacDonald | 273/167 F |
| 4,630,826 | 12/1986 | Nishigaki et al. | 273/167 |
| 4,740,345 | 4/1988 | Nagasaki | 273/167 H |
| 4,792,139 | 12/1988 | Nagasaki | 273/167 H |
| 4,793,616 | 12/1988 | Fernandez | 273/169 |
| 4,824,110 | 4/1989 | Kobayashi | 273/169 |
| 4,848,747 | 7/1989 | Fujimura | 273/167 H |
| 5,016,882 | 5/1991 | Fujimura | 273/169 |
| 5,016,883 | 5/1991 | Kobayashi | 273/167 |
| 5,154,425 | 10/1992 | Nishanen et al. | 273/167 J |

*Primary Examiner*—Sebastiano Passaniti

*Attorney, Agent, or Firm*—Terry J. Anderson; Karl J. Hoch, Jr.

[57] ABSTRACT

A golf club head comprising a head body which defines the front striking face of the club head. Disposed within the head body is a ceramic insert which defines the rear face of the club head. The head body is cast about the insert in a manner wherein the insert is partially encapsulated by the head body and rigidly captured therewithin.

8 Claims, 1 Drawing Sheet

METHOD OF MANUFACTURING GOLF CLUB HEAD WITH INTEGRAL INSERT

FIELD OF THE INVENTION

The present invention relates generally to golf clubs, and more particularly to an improved golf club head which is formed by casting metal material about a ceramic insert.

BACKGROUND OF THE INVENTION

As is well known, in becoming proficient in the game of golf, it is necessary for the golfer to consistently hit the golf ball from the tee box and fairways with distance and accuracy. Although golf swings vary from golfer to golfer, a proper golf swing from the tee box or fairway entails that the wood or iron be swung in an arcuate fashion, with the momentum imparted to the golf ball by the club head being controlled by the amount of back swing as well as the impact velocity of the front face of the club head upon the golf ball.

With particular respect to "irons", the club head of each iron typically defines a neck portion for attachment to one end of the club shaft, a heel, a toe, a sole, a front striking face, and a rear face. When the sole of the club head is rested upon a horizontal surface, the front face is offset from a vertical axis extending perpendicularly from the horizontal surface by a selected angle commonly referred to as the "loft angle". In this respect, the higher the numerical designation of a particular iron, the greater the loft angle. As will be recognized, the loft angle of the front face of the club head determines the trajectory of the golf ball when the same is properly impacted by the front face.

In the prior art, the club heads of irons are typically produced via an investment casting or forging process wherein a quantity of molten wax is poured into a mold cavity which approximates the shape of the club head. The wax hardens into a wax pattern which is subsequently removed from within the mold cavity and coated with plaster or ceramic via a dipping, spraying, or molding process. Once the coating has solidified into an outer shell, the wax pattern is melted and the wax drained from within the outer shell. Thereafter, a molten metal material such as stainless steel is poured into the outer shell. Upon the solidification of the metal material into the club head, the outer shell is removed therefrom, with the club head subsequently undergoing finish machining operations.

There has been an ongoing effort in the prior art to design club heads for irons wherein the weight is distributed in a manner making the golf club more forgiving by creating a larger "sweet spot", or correcting for slices and/or hooks by imparting spin onto the golf ball which compensates for an improper orientation of the front face relative to the golf ball at impact. To achieve the desired weight distribution characteristics, there has been developed in the prior art club heads for irons which include an extremely hard insert material disposed within the front face and/or rear face of the club head. Typically, such insert is separately formed and subsequently adhesively bonded or mechanically fastened into a recess formed within the front and/or rear face. The use of an adhesive has proven deficient, often times resulting in the hardened insert becoming dislodged due to the high impact forces exerted upon the front face of the club head. Additionally, the use of adhesives between the hardened insert and the club head often serve to dampen the impact forces and thereby reduce the overall length of the golf shot. In this respect, gluing the pre-fabricated insert into the club head, and in particular into the front face thereof, is typically less effective in transferring the load of the gold ball impact to the club head, thus resulting in a loss of feel and distance.

The present invention overcomes the deficiencies associated with prior art club heads for irons by providing a method of manufacturing a club head incorporating a ceramic insert which defines the rear face of the club head and redistributes weight from the center of the front face to the perimeter thereof, thus increasing the size of the "sweet spot" without increasing the overall weight of the club head. In addition to increasing the size of the sweet spot, the inclusion of the insert displaces weight away from the center of the club head, thus increasing the golf club's moment of inertia and making it a better, more forgiving club to hit. In the present manufacturing method, a head body of the club head is cast about the insert in a manner wherein the insert is partially encapsulated by the head body and rigidly captured therewithin. Advantageously, the encapsulation of the insert by the subsequently casted head body mechanically locks the same in place, thus eliminating the need for bonding or secondary attachment methods. Further, the inclusion of the insert within the club head increases the stiffness of the front face thereof. The insert may be selectively located within the club head as desired to improve weight distribution, increase or maintain stiffness of the front face, and improve acoustics (i.e., the sound emitted from a "good hit").

SUMMARY OF THE INVENTION

In accordance with the present invention, there is provided a golf club head comprising a head body which defines a front striking face of the club head and a neck portion for attaching the club head to one end of an elongate club shaft. Disposed within the head body is an insert which defines a rear face of the club head. The head body is cast about the insert in a manner wherein the insert is partially encapsulated by the head body and rigidly captured therewithin.

In the preferred embodiment, the insert defines a continuous peripheral edge, with the head body being cast about the insert in a manner wherein the peripheral edge is completely encapsulated thereby. The front striking face of the head body preferably includes a plurality of recessed score lines formed therewithin. The head body itself is preferably fabricated from stainless steel, with the insert preferably being fabricated from a ceramic material, and more particularly a fiber-reinforced ceramic material.

Further in accordance with the present invention, there is provided a method of manufacturing a golf club head which comprises the step of suspending a fiber-reinforced ceramic insert within a mold cavity having a configuration which approximates the shape of the club head. Thereafter, a quantity of molten wax is poured into the mold cavity, with the wax flowing about the insert and hardening into a wax pattern which partially encapsulates the insert. Subsequent to the removal of the wax pattern from within the mold cavity, a plaster or ceramic coating is applied to the wax pattern and insert via a dipping or spraying process, with the coating hardening into an outer shell.

After the coating has solidified into the outer shell, the wax pattern is melted and the wax drained from within the outer shell, with the insert remaining positioned therewithin. Thereafter, a quantity of molten stainless steel is poured into the outer shell, with the metal flowing about the insert and hardening into a head body which partially encapsulates and rigidly captures the insert. The head body defines the front striking face of the club head, with the insert defining the rear face of the club head. Subsequent to the solidification of the metal, the outer shell is removed from the club head. The club head is then machined to remove the metal and ceramic locating ears or to form a plurality of recessed score lines within the front striking face of the head body.

BRIEF DESCRIPTION OF THE DRAWINGS

These, as well as other features of the present invention will become more apparent upon reference to the drawings wherein.

DETAILED DESCRIPTION OF THE PREFERRED EMBODIMENT

Figure 2:
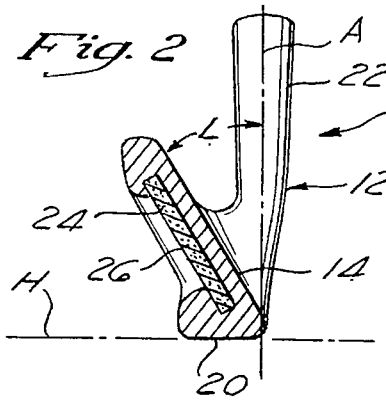
FIG. 2 is a cross-sectional view taken along line 2—2 of FIG. 1.
Figure 1:
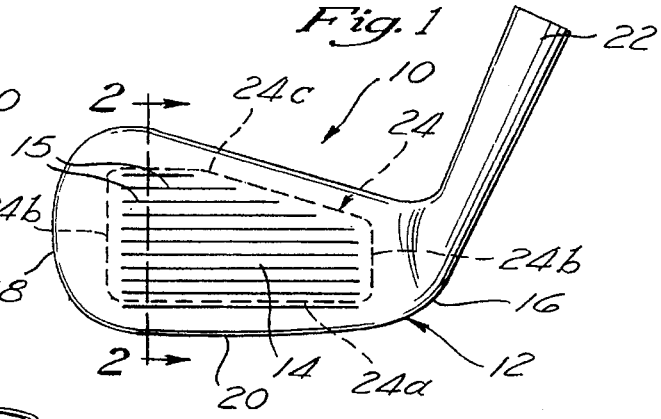
FIG. 1 is a front elevational view of a golf club head constructed in accordance with the present invention.

Referring now to the drawings wherein the showings are for purposes of illustrating a preferred embodiment of the present invention only, and not for purposes of limiting the same, FIGS. 1 and 2 are front elevational and cross-sectional views, respectively, of a golf club head 10 constructed in accordance with the present invention. The club head 10 comprises a head body 12 which defines a front or impact face 14 of the club head 10. In addition to the front face 14, the head body 12 defines a heel portion 16, a toe portion 18, a sole portion 20, and an elongate neck portion 22 which has a generally circular cross-sectional configuration and is used to attach the club head 10 to one end of an elongate club shaft (not shown). Disposed within the front face 14 are a plurality of recessed score lines 15 which extend horizontally across the front face 14. The club head 10 further comprises an insert 24 which is disposed within the head body 12 and defines a substantial portion of the rear face 26 of the club head 10. As will be discussed in more detail below, the club head 10 is formed by the casting of the head body 12 about the insert 24 in a manner wherein the insert 24 is partially encapsulated by the head body 12 and rigidly captured therewithin.

The club head 10 constructed in accordance with the present invention is configured for use as a component of an "iron". In this respect, when the sole portion 20 of the club head 10 is rested upon a horizontal surface H, the front face 14 is typically offset from the axis A of the neck portion 22 (which extends perpendicularly relative to the horizontal surface H) by a loft angle L. In typical iron construction, the higher the numerical designation of a particular iron, the greater the loft angle L. As will be recognized, the loft angle L determines the trajectory of the gold ball when the same is properly impacted by the front face 14 of the club head 10. Though the club head 10 is shown in FIG. 2 as having a particular loft angle L, it will be recognized that the forming method as will hereinafter be described may be utilized to fabricate a club head having any desired loft angle L.

Figure 3A:
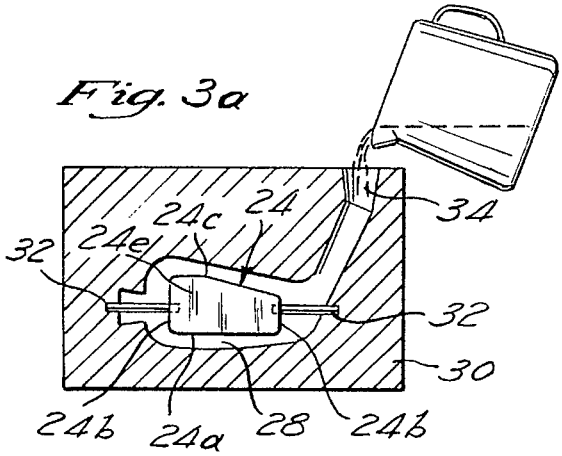
FIG. 3*a* is a cross-sectional view illustrating the step of pouring a quantity of molten wax into a mold cavity which approximates the shape of the club head and includes an insert suspended therewithin.

Referring now to FIGS. 3*a*–3*h*, the club head 10 is preferably fabricated by initially suspending the insert 24 within a mold cavity 28 of a mold 30. The mold cavity 28 has a configuration which approximates the shape of the club head 10, and in particular the head body 12 thereof. Additionally, as best seen in FIGS. 1 and 3*a*, the insert 24 has a shape approximating that of the front face 14. In this respect, the insert 24 defines a continuous peripheral edge consisting of a horizontally extending bottom edge portion 24*a* and opposed, vertically extending side edge portions 24*b*. In addition to the bottom and side edge portions 24*a*, 24*b*, the peripheral edge of the insert 24 includes a top edge portion 24*c* having a horizontally extending segment and a sloped segment which extends between the horizontal segment and one of the side edge portions 24*b*. Due to the inclusion of the sloped segment in the top edge portion 24*c*, the side edge portion 24*b* to which the sloped segment extends is of a shorter length than the other side edge portion 24*b*.

When the insert 24 is properly suspended within the mold cavity 28, the bottom edge portion 24*a* extends along the sole portion of the mold cavity 28, with the side edge portion 24*b* of greater length being disposed closest the toe portion thereof and the side edge portion 24*b* of shorter length being disposed closest the heel/neck portion thereof. The suspension of the insert 24 within the mold cavity 28 is preferably accomplished through the utilization of a pair of pin members 32 which are attached to respective side edge portions 24*b* of the insert 24 and extend horizontally through the heel and toe portions of the mold cavity 28 into the mold 30. Additionally, a substantial portion of the back side 24*d* of the insert 24 is abutted directly against an interior surface of the mold cavity 28 such that a gap is defined between the front side 24*e* of the insert 24 and the front face portion of the mold cavity 28. In the preferred embodiment, the insert 24 is fabricated from a ceramic material, and more particularly a fiber-reinforced ceramic material such as that which is commercially available from the Allide-Signal Corporation under the trademark BLACKGLAS®. The density to modulus ratio of ceramic is preferable to steel or alternate insert materials, with the fiber reinforced ceramic variant being preferred due to the additional strength provided thereby.

Subsequent to the suspension of the insert 24 within the mold cavity 28 in the aforementioned manner, a quantity of molten wax is poured into the mold cavity 28 via an inlet port 34 disposed within the mold 30. The molten wax flows about the insert 24, and in particular the front side 24*e* and peripheral edge (i.e., edge portions 24*a*, 24*b*, 24*c*) thereof. The molten wax does not flow over a substantial portion of the back side 24*d* of the insert 24 which, as previously explained, is abutted against an interior surface of the mold cavity 28.

Figure 3B:
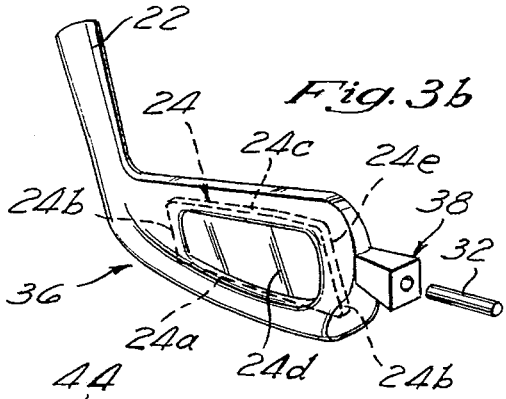
FIG. 3*b* is a rear perspective view of a wax pattern including the insert disposed therewithin which is formed by the step shown in FIG. 3*a*.

Referring now to FIG. 3*b*, the molten wax poured into the mold cavity 28 hardens into a wax pattern 36 which is removed from within the mold 30 and has a configuration approximating the shape of the club head 10. The shape of the wax pattern 36 is identical to that of the head body 12, except that the wax pattern 36 further includes a locating ear 38 formed on the toe portion thereof. Importantly, the insert 24 is disposed within the wax pattern 36, with the front side 24*e* and edge portions 24*a*, 24*b*, 24*c* thereof being completely encapsulated by the wax pattern 36. In this respect, only a substantial portion of the back side 24*d* of the insert 24 remains exposed. Upon the removal of the wax pattern 36 and integral insert 24 from within the mold 30, the pin members 32 are detached from the insert 24 and removed from within the wax pattern 36, with the resultant apertures being subsequently filled with additional quantities of molten wax.

Figure 3C:
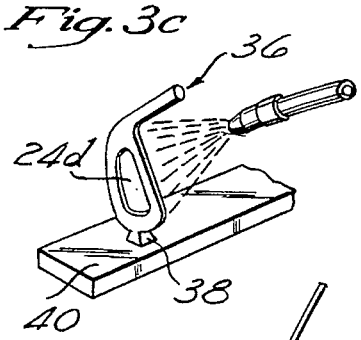
FIG. 3*c* is a front perspective view illustrating the step of applying a coating to the wax pattern shown in FIG. 3*b*.

Referring now to FIG. 3*c*, subsequent to the removal of the pin members 32 from within the wax pattern 36, the same is mounted to a support fixture 40 via its locating ear 38. After the wax pattern 36 has been mounted to the support fixture 40, a plaster or ceramic coating is applied thereto and to the exposed back side 24*d* of the insert 24. The coating is preferably applied via a dipping process, though the same may alternatively be applied via a spraying process as shown in FIG. 3.

Figure 3D:
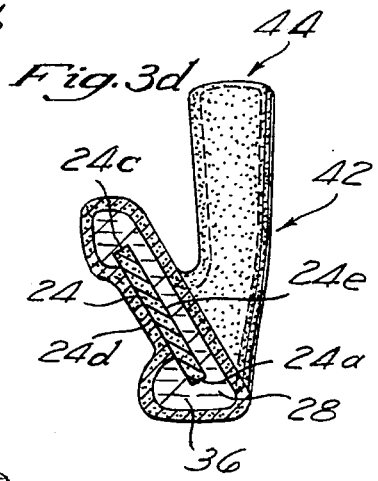
FIG. 3*d* is a cross-sectional view of an outer shell which is formed by the hardening of the coating and includes the wax pattern and insert disposed therewithin.
Figure 3E:
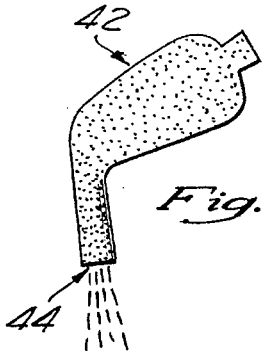
FIG. 3*e* is a front elevational view of the outer shell illustrating the step of draining the wax from within the interior thereof.

Referring now to FIG. 3*d*, the plaster or ceramic coating applied to the wax pattern 36 and back side 24*d* of the insert 24 hardens/solidifies into an outer shell 42. The coating is preferably applied to the wax pattern 36 in a manner wherein the resultant outer shell 42 does not cover the distal end of the neck portion thereof. Subsequent to the formation of the outer shell 42, heat is applied thereto in an amount sufficient to facilitate the melting of the wax pattern 36, with the molten wax being drained from within the outer shell 42 via the open end 44 thereof, in the manner shown in FIG. 3*e*. Importantly, the insert 24 remains positioned within the interior of the outer shell 42 despite the wax being drained from therewithin. In this respect, the application of the coating directly to the back side 24*d* of the insert 24 causes the same to remain in adhered engagement to the inner surface of the outer shell 42, even after the wax pattern 36 is removed from thereabout. As further seen in FIG. 3*e*, the coating is applied to all portions of the wax pattern 36, including the locating ear 38 disposed on the toe portion thereof.

Figure 3F:
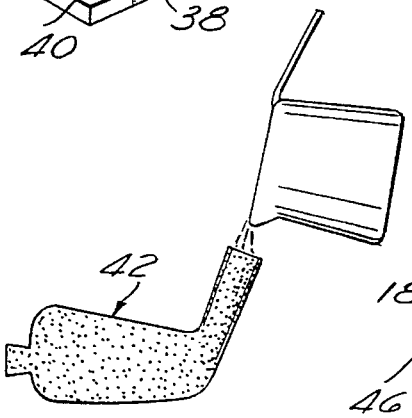
FIG. 3*f* is a front elevational view of the outer shell illustrating the step of pouring a quantity of molten metal into the interior thereof.

Referring now to FIG. 3*f*, subsequent to the drainage of the wax from within the outer shell 42, a quantity of molten metal, and preferably stainless steel, is poured into the interior thereof. The molten stainless steel flows about the exposed portions of the insert 24 within the outer shell 42, and in particular the front side 24*e* and peripheral edge thereof. As will be recognized, the molten stainless steel does not flow over a substantial portion of the back side 24*d* of the insert 24 since, as previously explained, the same is adhered directly to the outer shell 42 due to the direct application of the coating thereto. The hardening/solidification of the molten stainless steel facilitates the formation of the head body 12 which, like the wax pattern 36 previously described, includes the insert 24 disposed therein. In this respect, the front side 24*e* and peripheral edge (i.e., edge portions 24*a*, 24*b*, 24*c*) of the insert 24 are completely encapsulated by the head body 12, thus causing the insert 24 to be rigidly captured therewithin.

Figure 3G:
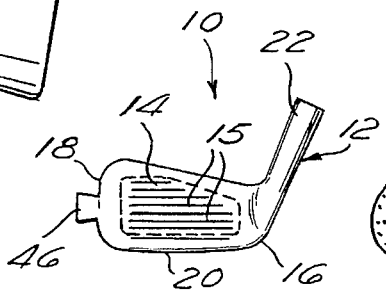
FIG. 3*g* is a front elevational view of the club head formed by the step shown in FIG. 3*f* subsequent to the removal of the outer shell therefrom.

Referring now to FIG. 3*g*, subsequent to the hardening of the molten stainless steel, the outer shell 42 is removed from the club head 10 comprising the head body 12 and integral insert 24. As previously explained, due to the casting of the head body 12 about the insert 24 and resultant encapsulation of the front side 24*e* and peripheral edge thereof, the insert 24 is rigidly captured within the head body 12 without the utilization of adhesives or mechanical fasteners which often adversely affect the performance characteristics of the golf club for the reasons previously discussed. Additionally, due to the head body 12 only partially encapsulating the insert 24, the portion of the back side 24*d* thereof which remains exposed defines a substantial portion of the rear face 26 of the club head 10, with the front face 14 thereof being defined by the head body 12.

Figure 3H:
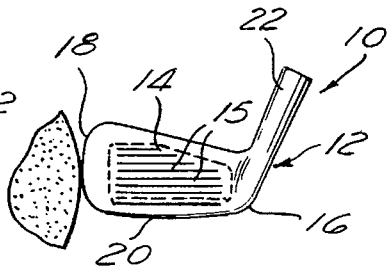
FIG. 3*h* is a front elevational view illustrating the step of machining the club head subsequent to the removal of the outer shell therefrom.

As further seen in FIG. 3*g*, due to the application of the coating to the locating ear 38 of the wax pattern 36, the head body 12 formed by the hardening/solidification of the molten stainless steel also includes a locating ear 46 disposed on the toe portion 18 thereof. As such, subsequent to the removal of the outer shell 42 from the club head 10, the locating ear 46 is removed via a grinding or other machining operation, as shown in FIG. 3*h*. Various finish machining operations may also be conducted on the remainder of the club head 10. For example, the recessed score lines 15 may be formed in the front face 14 if the same are not defined therewithin during the casting of the head body 12.

Though not shown, it will be recognized that the head body 12 may alternatively be cast about the insert 24 in a manner wherein the insert 24 is partially encapsulated by the head body 12 and defines a substantial portion of the front or impact face 14 of the club head 10 rather than the rear face 26 thereof. Additionally, the head body 12 may be cast about the insert 24 in a manner wherein the insert 24 is completely encapsulated by the head body 12 and thus disposed within the interior thereof.

Additional modifications and improvements of the present invention may also be apparent to those skilled in the art. Thus, the particular combination of parts and steps described and illustrated herein is intended to represent only one embodiment of the present invention, and is not intended to serve as limitations of alternative devices within the spirit and scope of the invention.

What is claimed is:

1. A golf club head comprising:

a head body defining a front striking face, a rear face, and an interior cavity having a peripheral sidewall, said rear face having a window formed therein which communicates with the interior cavity, said window including a peripheral edge which is disposed inwardly relative to the peripheral sidewall; and a pre-formed ceramic insert disposed within the interior cavity;

said head body being formed about said ceramic insert to facilitate the rigid capture of the ceramic insert within the interior cavity of the head body in a manner preventing the non-destructive removal of the ceramic insert from within the interior cavity.

2. The golf club head of claim 1 wherein the front striking face includes a plurality of recessed score lines formed therewithin.

3. The golf club head of claim 1 wherein said head body is formed of a stainless steel.

4. The golf club head of claim 1 wherein said ceramic insert is formed of a fiber-reinforced ceramic material.

5. The golf club head of claim 1 wherein said head body further defines a neck portion for attaching the club head to an elongate shaft.

6. The golf club head of claim 1 wherein the head body is cast in place about the ceramic insert.

7. A golf club head comprising:

a head body defining a front striking face of the club head; and a pre-formed ceramic insert having front and back surfaces and a continuous peripheral edge, said ceramic insert being disposed within said head body and defining a rear face of the club head;

said head body being formed about said ceramic insert in a manner wherein the front surface, the peripheral edge, and a peripheral region of the back surface of the ceramic insert are encapsulated by the head body to rigidly capture the ceramic insert therewithin and prevent the non-destructive removal of the ceramic insert therefrom.

8. The golf club head of claim 7 wherein the head body is cast in place about the ceramic insert.

* * * * *